US005305963A

United States Patent [19]

Harvey, III et al.

[11] Patent Number: 5,305,963

[45] Date of Patent: Apr. 26, 1994

[54] METHOD AND APPARATUS FOR FORMING ROLLS FROM STRIPS OF COMPRESSIBLE MATERIAL

[75] Inventors: Emerson C. Harvey, III, Lawrenceville, Ga.; Robert J. Allwein, Littleton, Colo.; Larry J. Weinstein, Littleton, Colo.; Jo M. Teague, III, Littleton, Colo.

[73] Assignee: Schuller International, Inc., Denver, Colo.

[21] Appl. No.: 984,765

[22] Filed: Dec. 3, 1992

[51] Int. Cl.[5] ..... B65H 18/16; B65H 18/08

[52] U.S. Cl. ..... 242/55.1; 100/40; 100/76; 242/DIG. 3

[58] Field of Search ..... 242/55.1, 67.1 R, 67.2, 242/75.1, DIG. 3; 100/40, 76, 78, 152

[56] References Cited

U.S. PATENT DOCUMENTS

| | | | |
|---|---|---|---|
| 2,881,984 | 4/1959 | Dyken | 242/DIG. 3 |
| 3,991,538 | 11/1976 | Finn et al. | 242/DIG. 3 X |
| 4,583,697 | 4/1986 | Bichot et al. | 242/55.1 |
| 4,653,397 | 3/1987 | Gray et al. | 242/55.1 X |
| 4,928,898 | 5/1990 | Audren et al. | 242/55.1 |

*Primary Examiner*—Daniel P. Stodola
*Assistant Examiner*—John Roccins
*Attorney, Agent, or Firm*—Cornelius P. Quinn

[57] ABSTRACT

A method and apparatus for forming spiral wound rolls from strips of compressible material uses a first endless belt conveyor to deliver the strips of compressible material into a winding space. As the strip enters the winding space, the strip is compressed by a compression and slider plate to the desired thickness for the layers of strip material in the spiral roll. Then, the leading portion of the strip successively contacts: an inclined, second endless belt conveyor, a compression roll, and a third endless belt conveyor which together with the first conveyor define the winding space. The second conveyor extends upwardly at an acute angle to the first conveyor and as the strip of compressible material contacts the second conveyor it maintains the strip in compression and starts to turn the strip back upon itself to form the spiral roll. The strip next contacts the compression roll which is located intermediate the first and second conveyors. The compression roll continues to turn the strip back upon itself and maintains the strip in compression. The strip next contacts the third conveyor which is located intermediate to the compression roll and the first conveyor. The third conveyor maintains the strip in compression and guides leading portions of the strip inside trailing portions of the strip being fed into the winding space by the first conveyor to complete the spiral winding of each layer of the strip in the roll. The compression roll and the third conveyor and compression and slider plate are moved to enlarge the winding space as the diameter of the spiral roll increases during the winding operation.

19 Claims, 3 Drawing Sheets

METHOD AND APPARATUS FOR FORMING ROLLS FROM STRIPS OF COMPRESSIBLE MATERIAL

FIELD OF THE INVENTION

This invention relates to an apparatus and method for forming spiral wound rolls from strips of compressible material wherein the strips are wound under compression and tension to minimize the diameter of the rolls.

BACKGROUND OF THE INVENTION

In the insulation industry, felts of mineral fibers, such as fine diameter glass fibers, are formed into strips which are to be used for the thermal and/or acoustical insulation of buildings and other structures or apparatus. These glass fiber felts are low in density and comprise fine glass fibers which entrap air in dead air pockets to achieve the thermal and acoustical insulating properties desired. The market demand for increasingly greater thermal and acoustical insulation performance has resulted in the production of increasingly thicker strips of insulation felts to achieve the insulation properties desired. For shipping and handling purposes it is desirable to compress these felts and form the strips into rolls for packaging wherein the strips are greatly reduced in volume from their normal uncompressed state e.g. up to a 9 to 1 compression ratio. This reduction in volume saves on freight costs for the product and the resulting smaller diameter packages are easier to handle during shipment and at the job site. However, for insulating purposes, it is important that the strips of insulation recover to substantially their original thickness when released from the packages to thereby retain their insulating properties.

It has been found that the repeated compression, expansion and recompression of these strips of glass fiber felts in the winding and packaging operation damages the felts so that the felts do not recover as fully. Thus, in a winding and packaging operation where the strips are allowed to expand even partially after their initial compression, the recovery will be affected and to obtain a smaller diameter roll with good recovery, it is necessary to minimize any expansion of the strips of felt once the strips have been initially compressed. Otherwise, to retain the desired recovery and insulating properties for the strips, it is necessary to form larger diameter rolls thereby increasing freight costs, requiring more storage space for the product and making the product harder to handle prior to installation.

The formation of the spiral wound roll must be accomplished without the formation of a hard center core or the telescoping of the roll. If the center core is too tightly wound in an attempt to form a smaller diameter roll, the portion of the felt strip forming the core will be excessively damaged affecting its recovery and insulating properties. The smaller diameter roll must also be obtained without causing the roll to telescope at its center thereby making the roll unsuitable for packaging.

It is also important to form a roll of such dimensions that when it is packaged, the roll can be further compressed in one direction to form a readily stackable package when turned on its side. The rolls are packaged in such a way that advertising and other information appears on the circumference of the packaged roll. If the package formed from the roll is too narrow, the packages of the rolled strip insulation will not be stable for stacking and will be less acceptable in the market place where it is desirable to show the advertising and other information appearing on the circumference of the package.

In the winding machines of the prior art such as the winding machine shown and described in U.S. Pat. No. 4,928,898, the winding space is defined by three members: an infeed conveyor, an inclined conveyor and a compression roll. With this arrangement, the outer layer of the felt strip being wound onto the roll can expand after it passes the compression roll and before it passes inside the trailing portion of the felt strip being fed into the winding space. This results in an additional expansion and recompression of the felt strip which causes damage to the glass fibers in the strip and requires the formation of a larger diameter roll, if the strip is to exhibit proper recovery, than would be required if the additional expansion and recompression were eliminated or minimized. In addition, should an attempt be made to wind a roll too small in diameter with such equipment, the roll can telescope and/or have too hard a core which adversely affects the recovery of the strip of compressible material.

BRIEF DESCRIPTION OF THE INVENTION

The present invention is a method and apparatus for forming spiral wound rolls from strips of compressible glass fiber insulation or other compressible strip materials. A first endless belt conveyor delivers the strips of compressible material into a winding space.

As the strip of compressible strip material enters the winding space, the strip is compressed by a compression and slider plate assembly to the desired thickness for the layers of strip material in the spiral roll. The leading portion of the strip of compressible material successively contacts: an inclined second endless belt conveyor, a compression roll and a third endless belt conveyor which, together with the first endless belt conveyor, define the winding space.

The second endless belt conveyor extends upwardly in an upstream direction at an acute angle to the first endless belt conveyor. As the strip of compressible material contacts the second conveyor, the second conveyor starts to turn the strip of compressible material back upon itself to form the spiral roll. The second conveyor, in cooperation with the other conveyors and the compression roll, maintains the strip in tension and compression as the strip is wound.

The strip of compressible material next contacts the compression roll which is located intermediate the first and second conveyors. The compression roll continues to turn the strip of compressible material back upon itself to form the core of the roll while cooperating with the conveyors to maintain the strip of compressible material in tension and compression.

After the core of the spiral wound roll is formed, the strip of compressible material is engaged by the third endless belt conveyor which is located intermediate the compression roll and the first endless belt conveyor. The third endless belt conveyor, in cooperation with the other conveyors and the compression roll, maintains the strip of compressible material in compression and tension during the remainder of the winding cycle. In addition, the third endless belt conveyor guides leading portions of the strip of compressible material inside trailing portions of the strips being fed into the winding space by the first endless belt conveyor to complete the spiral winding of each layer of strip material in the roll.

The compression roll and the third endless belt conveyor and compression and slider plate assembly are moved in a generally upstream direction as the roll is formed to enlarge the winding space as the diameter of the spiral roll of compressible material increases. The movement is regulated to keep the compression roll and the third endless belt conveyor properly located relative to the roll to maintain the strip in tension and compression while it is being wound.

With the addition of the third endless conveyor, intermediate the compression roll and the infeed conveyor and the outward movement of the compression roll in a substantially straight line rather than in a arc, the expansion of the strip of compressible material after the strip passes the compression roll is minimized. This arrangement has enabled strips of compressible material to be formed into rolls having diameters of 26 inches as compared with 30 inches when not using the arrangement. Thus, strips of compressible material wound in accordance with the present invention form a roll having a volume about 25% less than those wound in accordance with the previous method and apparatus and exhibit the same recovery as strips wound with the previous method and apparatus. Furthermore, the rolls do not telescope when wound to this diameter and the center core is not as tightly wrapped as with the previous method and apparatus so that the core exhibits better recovery.

When the rolls formed from the present invention are packaged, the rolls can be compressed in one direction to flatten out the roll and form a roll 19 inches by 28 inches. This compares with a flattened roll formed by the previous method and apparatus which had dimensions of 14 inches by 36 inches. Accordingly, when the rolls made by the present invention are packaged, the resultant package is much more stable when placed on its side for display or storage.

DETAILED DESCRIPTION OF THE INVENTION

Figure 1:
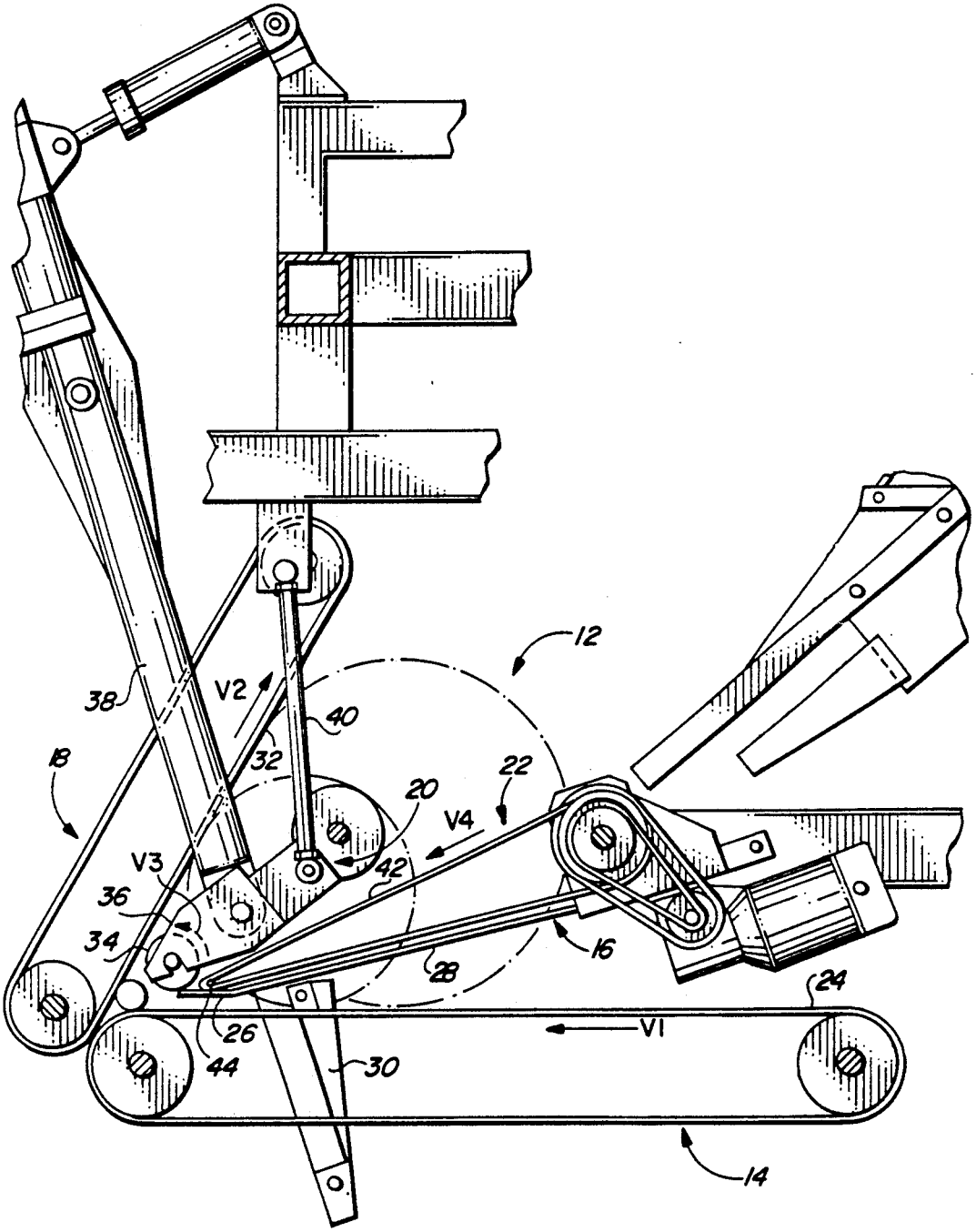
FIG. 1 is a side elevation of the winding apparatus of the present invention as the winding of a roll is to be initiated.
Figure 2:
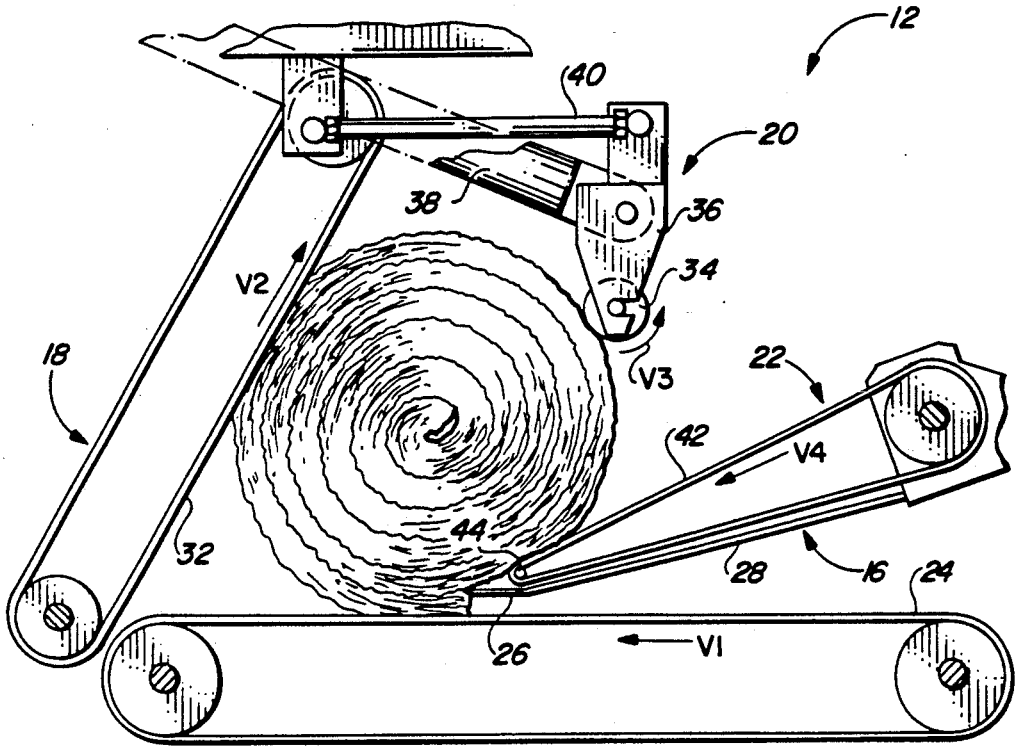
FIG. 2 is a side elevation of the winding apparatus of the present invention as the winding of a roll is being completed.

Referring to FIGS. 1 and 2, the winding apparatus of the present invention is indicated at 12. The winding apparatus comprises a first endless belt conveyor 14, a compression and slider plate assembly 16, a second endless belt conveyor 18, a compression roll assembly 20 and a third endless belt conveyor 22. FIG. 1 illustrates the relative positions of the components of the winding apparatus 12 at the beginning of a winding cycle and FIG. 2 illustrates the relative positions of the components of the winding apparatus at the end of the winding cycle.

As shown in FIGS. 1 and 2, the first endless belt conveyor has a substantially horizontal conveying surface 24 which conveys the strips of compressible material into a winding space defined by the first endless belt conveyor 14, the second endless belt conveyor 18, the compression roll assembly 20 and, after the core of the roll is formed, the third endless belt conveyor 22.

Adjacent and above the conveying surface 24 is the compression and slider plate assembly 16. The compression and slider plate assembly 16 has a trailing portion 26 which extends substantially parallel to the conveying surface 24 of the conveyor 14. The compression and slider plate assembly has a leading portion 28 which extends upwardly from the trailing portion 26 in the upstream direction at an acute angle to the conveying surface 24 of the conveyor 14.

The preferred angle of the leading portion 28 of the compression and slider plate assembly to the conveying surface 24 of the conveyor 14 is 14 degrees. However, the angle could be varied within certain limits determined by the amount of damage that can be tolerated in the product being wound. If the angle is too small, contact between the product and the compression and slider plate assembly 16 will cause excessive drag on the product and damage the product. If the angle is too large, the product may not feed smoothly under the compression and slider plate assembly 16. This would also cause excessive damage to the product.

The compression and slider plate assembly 16 extends across the entire width of the production line having substantially the same width as the conveyor 14. The compression and slider plate assembly 16 is mounted on a frame 30 which moves parallel to the conveying surface 24 of the conveyor 14 as the roll of compressible strip material increases in diameter during the winding operation. The compression and slider plate assembly 16 is shown in its initial position for a winding cycle in FIG. 1 and in its final position for a winding cycle in FIG. 2.

The second endless belt conveyor 18 is located at the downstream end of the first endless belt conveyor 14. The conveying surface 32 of the second endless belt conveyor 18 is the same width as conveying surface 24 and the conveying surface extends upwardly from the downstream end of the first conveyor 14 at an acute angle. The conveying surface of the second conveyor runs in an upward direction as shown in FIGS. 1 and 2.

The angle of the conveying surface 32 of the second endless belt conveyor 18 to the conveying surface 24 of the first endless belt conveyor 14 is preferably 60 degrees. The angle between the conveying surfaces 32 and 24 could be varied from as little as 45 degrees to as much as 85 degrees and the winding apparatus 12 would still work. However, one purpose of the second endless belt conveyor 18 is to restrain the roll of compressible strip material being formed in the winding apparatus. Too low an angle would cause the roll being wound to move to far upstream in the winding space restricting the space for the third endless belt conveyor 22 and the compression and slider plate assembly 16. Too large an angle between the conveying surfaces 24 and 32 would cause the roll to lift out of the winding space as the velocity of the conveying surface 32 is greater than that of the conveying surface 24.

The compression roll assembly 20 is located intermediate to the first endless belt conveyor 14 and the second endless belt conveyor 18. The compression roll assembly comprises a compression roll 34 which is substantially the same width as conveying surface 24 and is mounted on a frame 36 which is supported by pairs of arms 38 and 40. As shown in FIG. 1, the compression roll 34 rotates in a counter-clockwise direction.

As shown in FIG. 1, the conveying surface 24 of the first endless belt conveyor 14, the downstream end of portion 26 of the compression and slider plate assembly 16, the conveying surface of the second endless belt conveyor 18 and the compression roll 34 define the winding space at the initiation of the winding cycle. After the core of the roll is formed, the outer layer of the roll is engaged by the third endless belt conveyor 22.

FIG. 2 shows the location of the compression roll assembly at the end of the winding cycle. With the use of the support linkage arms 38 and 40, the compression roll 34 is moved from the position illustrated in FIG. 1 to the position shown in FIG. 2, along a substantially straight line inclined at an angle of approximately 35 degrees to the conveying surface 24 of the first endless belt conveyor 14. The movement of the compression roll 34 during the winding operation in an upstream direction at an angle of 35 degrees to the conveying surface 24 maintains the compression roll properly positioned relative to the third endless belt conveyor 22.

As shown in FIGS. 1 and 2, the third endless belt conveyor 22 is mounted on the compression and slider plate assembly frame 30 and moves with the compression and slider plate assembly in an upstream direction parallel to conveying surface 24 during the winding cycle. During the winding cycle, endless belt conveyors 14 and 18 are stationary. The compression roll assembly 20 and the compression and slider plate assembly 16 with the third endless belt conveyor 22 are moved upstream to enlarge the winding space as the roll increases in diameter.

The third endless belt conveyor 22 is substantially the same width as the first endless belt conveyor 14. As shown in FIGS. 1 and 2, the third endless belt conveyor 22 moves in a counterclockwise direction with the conveying surface 42 of the third endless belt conveyor in contact with the roll of compressible strip material causing the roll of compressible strip material to rotate in a clockwise direction. The positioning of the third endless belt conveyor intermediate the compression roll assembly 20 and the first endless belt conveyor 14 keeps the outer layer of the compressible strip material being wound onto the roll from expanding after it passes the compression roll 34 and before it passes inside a trailing portion of the strip material being fed into the winding space by the endless belt conveyor 14.

As shown in FIGS. 1 and 2, the conveyor belt on the third endless conveyor 22 passes around a nosebar 44 at the downstream end of the conveyor. As shown in FIG. 1, the use of the nosebar 44 rather than a roll enables the downstream end of the third conveyor to be positioned close to the compression roll 34, e.g. the nosebar can be about ½ inch in diameter by 120 inches long. This enables the third conveyor 22 to tuck the portion of the strip of compressible material forming the outer layer of the roll tightly within the trailing portion of the strip of compressible material being fed into the winding space by the first conveyor 14. It also prevents the expansion of the strip of compressible material after it passes the compression roll 34 and the resulting recompression of the strip as it is tucked inside the portion of the strip being fed into the winding space by the conveyor 14. With the use of the nosebar and the relatively short length of the conveyor when compared to its width, it is preferred to use sensors along each side of the conveyor belt to detect any tracking problems with the conveyor belt and continuously make any adjustments necessary to keep the conveyor belt on track.

The positioning of the compression and slider plate assembly 16 between the third endless belt conveyor 22 and the strip of compressible material being fed into the winding space by the conveyor 14 keeps the return run of the conveyor 22 from contacting the upper surface of the portion of the strip of compressible material being fed into the winding space. This prevents the upper surface of the strip of compressible material from being damaged by the third endless belt conveyor 22.

The first endless belt conveyor 14, the second endless belt conveyor 18, the compression roll 20 and the third endless belt conveyor 22 are all driven independently by conventional drives. With the drives for each of these components being separate, the velocities of the components can be independently set for optimum operation. In the preferred method of operation, the linear velocity (V2) of the second endless belt conveyor 18 is greater than the linear velocity (V1) of the first endless belt conveyor 14. The linear velocity (V3) of the compression roll 34 is greater than the linear velocity of the second endless belt conveyor 18. The linear velocity (V4) of the third endless belt conveyor 22 is greater than the linear velocity of the compression roll 34. Thus, the strip of compressible material, which has a certain amount of drag exerted upon it by the compression and slider plate assembly 16 undergoes acceleration after it passes from beneath the compression and slider plate assembly 16 and is being wound onto the roll to keep the strip in tension and maintain the thickness of the strip constant during the winding operation.

As just mentioned, the velocities of the conveyors and the compression roll are adjusted for different products to keep the strip under tension and to minimize product damage. For faced products V2 is typically 105% to 110% of V1; V3 is typically 105% to 112% of V1; and V4 is typically 103% to 112% of V1. For unfaced products, V2 is typically 108% to 115% of V1; V3 is typically 108% to 120% of V1; and V4 is typically 102% to 115% of V1.

Figure 3:
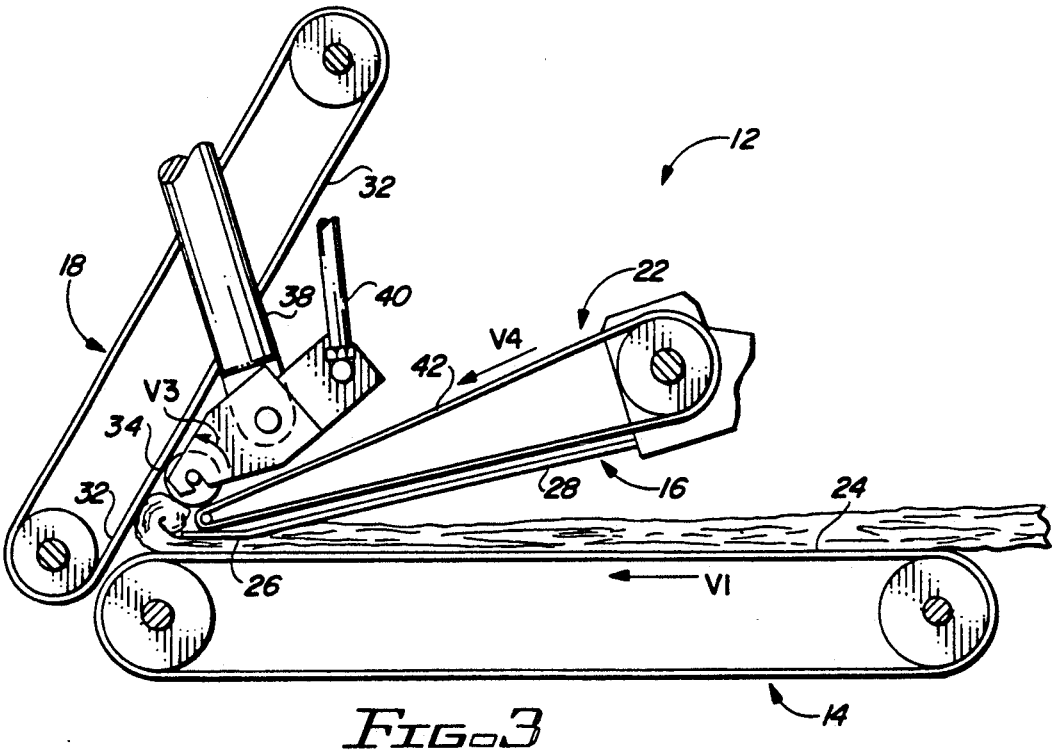
FIG. 3 is a schematic side elevation view of the winding apparatus of the present invention as the winding of a roll is being initiated.
Figure 4:
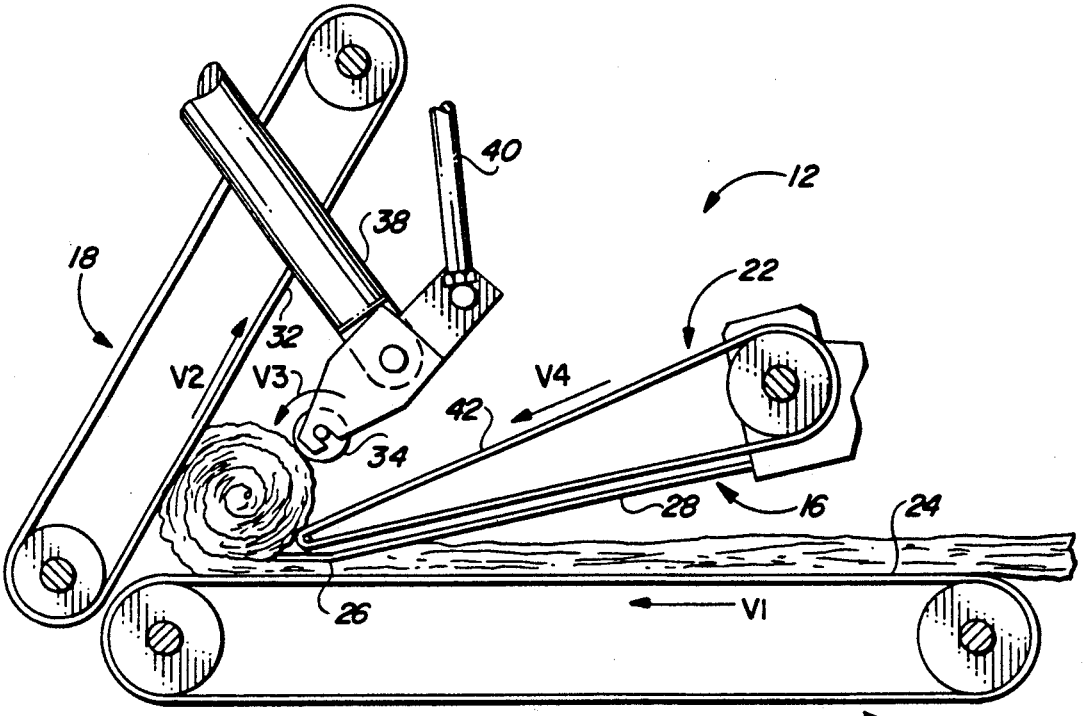
FIG. 4 is a schematic side elevation view of the winding apparatus of the present invention about midway through the formation of a roll.
Figure 5:
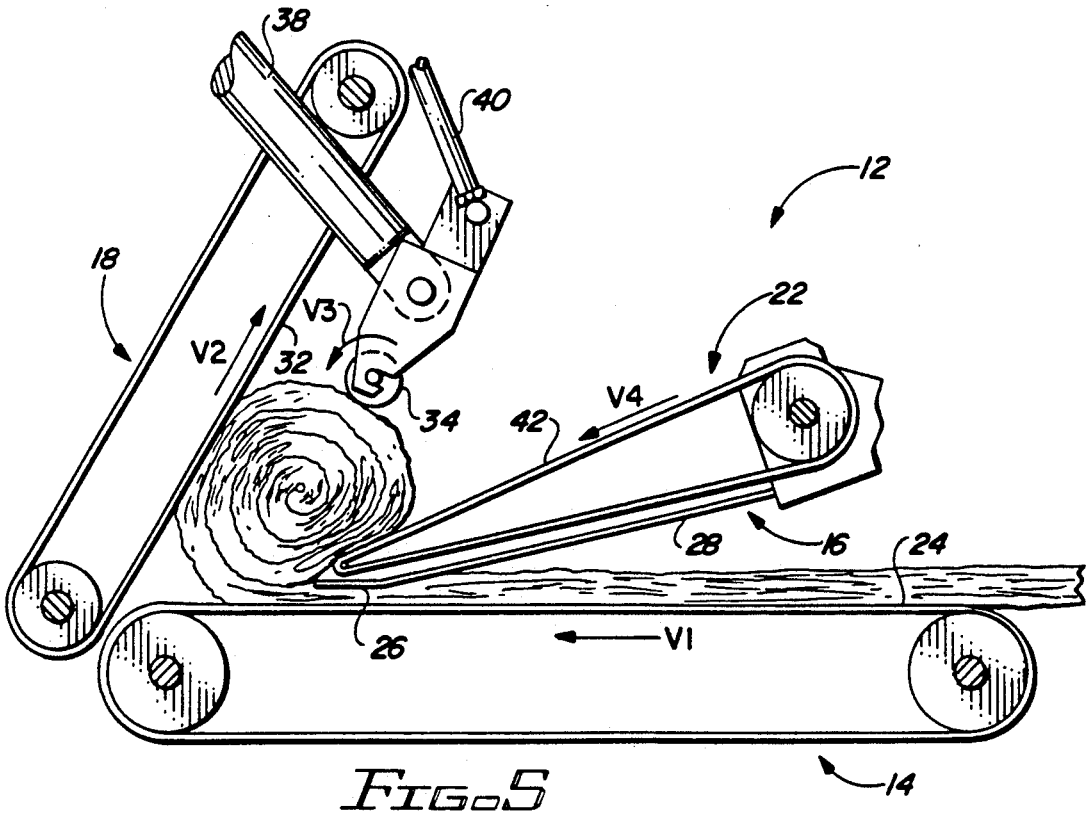
FIG. 5 is a schematic side elevation view of the winding apparatus of the present invention as a roll is being completed.

FIGS. 3, 4 and 5 schematically illustrate the winding process of the present invention. As shown in FIG. 3, a strip of glass fiber insulation, faced or unfaced and cut to a predetermined length, is fed longitudinally into the winding apparatus 12 from a production line which is not shown. The strip of glass fiber insulation is fed from the production line onto the endless belt conveyor 14 of the winding apparatus which feeds the strip into the winding space defined by the conveying surface 24 of conveyor 14, the downstream end of the trailing portion 26 of the compression and slider assembly 16, the conveying surface 32 of inclined conveyor 18 and the compression roll 34.

As the strip of insulation is fed beneath the compression and slider plate assembly 16, the strip is increasingly compressed by the leading portion 28 of the compression and slider plate assembly until the desired thickness for the strip is reached as defined by the spacing between the trailing portion 26 of the compression and slider plate assembly and the conveying surface 24 of the conveyor 14. As the compressed strip of insulation passes from beneath the trailing portion 26 of the compression and slider plate assembly into the winding space, the strip is contacted by the conveying surface 32 of the conveyor 18. The conveying surface 32, which is moving upward, begins to turn the strip back upon itself to form a spiral wound roll. The leading portion of the strip next contacts the compression roll 34 which turns the strip back upon itself to form the core of the spiral wound roll.

Once the core of the spiral wound roll is formed, the compression roll 34 is moved outwardly and the outer layer of the spiral wound roll is engaged by the third endless belt conveyor 22 as illustrated in FIG. 4. The position of the conveying surface 42 of the third endless belt conveyor 22 relative to the compression roll 34, which is maintained throughout the winding cycle, prevents the strip of insulation from expanding after it passes the compression roll 34 and causes the leading portions of the strip to be tucked tightly inside the trailing portions of the strip being fed into the winding space by the first conveyor 14.

As the spiral wound roll of insulation increases in diameter the compression roll 34, the compression and slider plate assembly 16 and the third endless belt conveyor 22 are moved upstream to enlarge the winding space. As shown in FIGS. 3, 4 and 5, during the winding cycle, the downstream end of the trailing portion 26 of the compression and slider plate assembly 16 is positioned at or slightly upstream from a line extending perpendicular to the conveying surface 24 of the first conveyor 14 and passing through the center of the spiral wound roll of insulation. This allows the insulation to flow smoothly into the roll from beneath the trailing portion 26 of the compression and slider plate assembly 16. If the downstream end of the trailing portion 26 is too far downstream of the roll center, the trailing portion 26 will cause the insulation passing from beneath the trailing portion into the roll to bulge out rather than smoothly passing into the roll. If the downstream end of the trailing portion 26 is to far upstream of the center of the roll, the insulation will re-expand before it reaches the roll nullifying the compression provided by the trailing portion 26 of the compression and slider plate assembly 16.

What we claim is:

1. A method for forming rolls from strips of compressible material comprising:

feeding a strip of compressible material to a winding space defined by a first driven, endless belt conveyor which delivers the strip of compressible material to the space; a second driven, endless belt conveyor extending upward at an acute angle from said first endless belt conveyor; a driven compression roll located intermediate said first and said second endless belt conveyors; and a third driven, endless belt conveyor located intermediate said driven compression roll and said first driven, endless belt conveyor; and causing the strip of compressible material to successively contact said second endless belt conveyor, said compression roll and said third endless belt conveyor to form a spirally wound roll from said strip of compressible material.

2. The method of claim 1 wherein tension is applied to the strip of compressible material as it is spirally wound into the roll.

3. The method of claim 2 wherein the tension is applied by having the velocity of the second endless belt conveyor greater than the velocity of the first endless belt conveyor, the velocity of the compression roll greater than the velocity of the second endless belt conveyor and the velocity of the third endless belt conveyor greater than the velocity of the compression roll.

4. The method of claim 3 wherein the thickness of each layer of the strip of compressible material in the spiral roll is set as the strip of compressible material is fed into the winding space.

5. The method of claim 1 wherein the thickness of each layer of the strip of compressible material in the spiral roll is set as the strip of compressible material is fed into the winding space.

6. The method of claim 1 wherein said third endless belt conveyor guides a portion of the strip of compressible material forming the outer layer of the spiral roll inside a portion of the strip of compressible material being fed into the winding space by the first endless belt conveyor.

7. The method of claim 6 wherein said third endless belt conveyor restricts the expansion of the outer layer of the spiral roll after the strip of compressible material passes the compression roll and before the strip of compressible material passes inside the portion of the strip of compressible material being fed into the winding space by the first endless belt conveyor.

8. The apparatus of claim 1 wherein the acute angle between the first endless belt conveyor and the second endless belt conveyor is between 45 and 85 degrees.

9. An apparatus for forming spirally wound rolls from strips of compressible material comprising:

a first endless belt conveyor, a second endless belt conveyor extending upwardly from an end of the first endless belt conveyor at an acute angle relative to the first endless belt conveyor, a compression roll intermediate the first and the second endless belt conveyors, and a third endless belt conveyor intermediate the compression roll and the first endless belt conveyor whereby the first endless belt conveyor, the second endless belt conveyor, the compression roll and the third endless belt conveyor define a winding space within which the spirally wound rolls are formed from the strips of compressible material;

means driving the first endless belt conveyor to deliver the strips of compressible material to the winding space, means driving the second endless belt conveyor to cause the strips of compressible material to begin to turn in a spiral, means driving the compression roll to cause the strips of compressible material to be turned further into the spiral, and means driving the third endless conveyor to cause leading portions of the strips of compressible material to be tucked inside trailing portions of the strips of compressible material to complete the formation of each spiral layer of the rolls.

10. The apparatus of claim 9 wherein a slider plate is located intermediate to the third endless belt conveyor and the first endless belt conveyor to compress the strips of compressible material to a thickness substantially the thickness the compressible material in the spiral rolls and to prevent the third endless belt conveyor from interfering with the delivery of the strips of compressible material into the winding space by the first endless belt conveyor.

11. The apparatus of claim 10 wherein the second endless belt conveyor is driven at a velocity greater than the velocity of the first endless belt conveyor, the compression roll is driven at a velocity greater than the velocity of the second endless belt conveyor, and the third endless belt conveyor is driven at a velocity greater than the velocity of the compression roll to maintain the strips of compressible material in tension as the strips of compressible material are being wound into the rolls.

12. The apparatus of claim 11 wherein the slider plate is located relative to the first endless belt conveyor to cooperate with the first endless belt conveyor to compress the strips of compressible material there between and to create a drag on the strips of compressible material to facilitate the tensioning of the strips of compressible material by the higher velocity second endless belt conveyor, the compression roll and the third endless belt conveyor.

13. The apparatus of claim 12 including means to move at least one of the first, second or third endless belt conveyors or the compression roll to enlarge the winding space as the spiral wound rolls of compressible strip material become greater in diameter during the winding process while maintaining the strips of compressible material in tension and compression.

14. The apparatus of claim 13 wherein the means to move comprises means for moving the compression roll and means for moving the third endless belt conveyor and the slider plate.

15. The apparatus of claim 14 wherein the means for moving the compression roll moves the compression roll outwardly from the first and second endless belt conveyors in substantially a straight line.

16. The apparatus of claim 14 wherein the third endless belt conveyor has a leading end which is in contact with the outer layer of the spiral roll of compressible material and the means to move the third endless belt conveyor and the slider plate moves the third endless belt conveyor and the slider plate in a direction parallel to the first endless belt conveyor to maintain a set spacing between the first endless belt conveyor and the slider plate as the spiral wound rolls grow in diameter and to maintain the leading end of the third endless belt conveyor at or ahead of a line perpendicular to the first endless belt conveyor and passing through the center of the roll of compressible strip material being wound.

17. The apparatus of claim 16 wherein the endless belt of the third endless belt conveyor passes around a nosebar at the leading, end of the third endless belt conveyor.

18. The apparatus of claim 16 wherein the means for moving the compression roll moves the compression roll outwardly from the first and second endless belt conveyors in a substantially straight line at an angle of approximately 35 degrees to the direction of travel of the first endless belt conveyor.

19. The apparatus of claim 16 wherein the slider plate has a downstream product thickness setting portion which extends parallel to the direction of travel of the first endless belt conveyor and an upstream portion which extends upwardly from the direction of travel of the first endless belt conveyor at an angle of approximately 14 degrees.

* * * * *